US008539936B2

(12) United States Patent
Bell et al.

(10) Patent No.: US 8,539,936 B2
(45) Date of Patent: Sep. 24, 2013

(54) SUPERCHARGER ROTOR SHAFT SEAL PRESSURE EQUALIZATION

(76) Inventors: James E. Bell, Upland, CA (US); Jan Erik Oscarsson, Saltsjö -Boo (SE)

( * ) Notice: Subject to any disclaimer, the term of this patent is extended or adjusted under 35 U.S.C. 154(b) by 1009 days.

(21) Appl. No.: 12/582,426

(22) Filed: Oct. 20, 2009

(65) Prior Publication Data

US 2011/0088667 A1 Apr. 21, 2011

(51) Int. Cl.
*F02B 33/00* (2006.01)

(52) U.S. Cl.
USPC ..... 123/559.1; 123/559.3; 418/9; 418/104; 418/206.1; 418/206.6

(58) Field of Classification Search
USPC ..... 123/559.1, 559.3; 418/206.1, 206.6, 418/104, 9
See application file for complete search history.

(56) References Cited

U.S. PATENT DOCUMENTS

| | | | | |
|---|---|---|---|---|
| 2,808,813 | A * | 10/1957 | Lindhagen et al. | 418/94 |
| 4,153,395 | A * | 5/1979 | O'Neill | 418/9 |
| 4,781,553 | A * | 11/1988 | Nomura et al. | 418/104 |
| 5,335,640 | A * | 8/1994 | Feuling | 123/559.1 |
| 5,836,753 | A * | 11/1998 | Takei et al. | 418/95 |
| 6,287,100 | B1 * | 9/2001 | Achtelik et al. | 418/104 |
| 6,408,832 | B1 * | 6/2002 | Christiansen | 123/563 |
| 6,612,820 | B1 * | 9/2003 | Staat et al. | 418/1 |
| 6,659,746 | B2 * | 12/2003 | Hoshino et al. | 418/104 |
| 6,663,366 | B2 * | 12/2003 | Okada et al. | 418/83 |
| 2002/0168279 | A1 * | 11/2002 | Yamamoto et al. | 418/104 |
| 2004/0028305 | A1 | 2/2004 | Akagami et al. | |
| 2005/0084404 | A1 * | 4/2005 | Okada et al. | 418/104 |
| 2006/0157036 | A1 * | 7/2006 | Andersen | 123/563 |
| 2007/0175456 | A1 * | 8/2007 | Tally | 123/559.1 |
| 2007/0296158 | A1 | 12/2007 | Datta | |
| 2008/0060622 | A1 * | 3/2008 | Prior | 123/559.1 |
| 2008/0240965 | A1 * | 10/2008 | Kimura et al. | 418/142 |
| 2009/0196743 | A1 | 8/2009 | Ueno et al. | |
| 2010/0018509 | A1 * | 1/2010 | Prior et al. | 123/559.1 |

FOREIGN PATENT DOCUMENTS

| | | | |
|---|---|---|---|
| EP | 1975410 | A1 * | 10/2008 |
| JP | 61016232 | A * | 1/1986 |
| JP | 62186016 | A * | 8/1987 |
| JP | 2007132243 | A * | 5/2007 |

* cited by examiner

*Primary Examiner* — Thomas Denion
*Assistant Examiner* — Patrick Maines
(74) *Attorney, Agent, or Firm* — Kenneth L. Green

(57) ABSTRACT

A pressure equalization system reduces or eliminates a pressure differential across supercharger rotor shaft seals. Under high boost, rotor shaft seals often fail, allowing hot compressed air into an oil lubricated space containing rotor bearings and gears (and vented to ambient pressure), reducing oil lubricating effectiveness and resulting in increased wear and failure. Under low or non boost operation, the pressure differential is reversed causing the lubricating oil to leak into the supercharger interior and accelerated rotor seal wear. The pressure equalization system includes flow restrictive seals on both rotor shafts, separated from the rotor shaft seals by vented spaces, thereby isolating the rotor shaft seals from boost or vacuum in the supercharger interior and reducing or eliminating the pressure differential across the rotor shaft seals. Maintaining close to atmospheric pressure on both sides of the rotor shaft seals during boost and vacuum operation reduces wear and failures.

11 Claims, 4 Drawing Sheets

SUPERCHARGER ROTOR SHAFT SEAL PRESSURE EQUALIZATION

BACKGROUND OF THE INVENTION

The present invention relates to supercharger seals and in particular to equalizing a pressure difference across a supercharger rotor shaft seal.

Power production of an internal combustion engine is ultimately limited by the amount of air pumped through each engine cylinder. Fuel systems can at best provide an optimal amount of fuel to burn with the air contained in the cylinder, and adding more fuel than required for a stoichiometric air-fuel ratio does not result in more energy being produced. The power production of non-supercharged engines is thus limited by the engine's ability to draw air into each cylinder, referred to the Volumetric Efficiency (VE) of the engine, where 100 percent VE is equivalent to complete filling of the cylinder at bottom dead center at one atmosphere of pressure. While some engines achieve greater than 100 percent VE using tuned intake manifolds providing a ram effect, the effects are generally limited to a small RPM range which the intake is tuned to.

Power production may also be realized by raising the RPM that an engine is operated at, thereby pumping more air through the engine. Unfortunately, high RPM operation requires cam lobe designs which are inefficient at low RPM, and is also stressful on engine parts.

An alternative method for increasing power production is to pump (or force) air into the engine. This approach is commonly called supercharging because more air is forced into each cylinder than 100 percent VE produces. For many years, supercharging was limited to special applications because of the power required to operate the supercharger (i.e., the parasitic draw of the supercharger) resulting in reduced fuel economy under all operating conditions.

One known supercharger is a screw compressor type supercharger employed to pump air into the engine at greater than atmospheric pressure to increasing horsepower. Screw compressor superchargers employ a pair of rotating screw elements (or rotors), within a confined cylindrical housing. The rotating screw elements draw air from a throttle body at a rear end of the housing and push the air progressing toward a forward end of the housing thereby compressing the air. The compressed air then flows into an intake manifold of the internal combustion engine. Providing the compressed air (commonly referred to as boost) and a corresponding amount of fuel, dramatically increases engine horsepower production and allows immediate and tremendous acceleration.

Twin screw type superchargers draw air into the rear of the supercharger and compress the air as it travels from the rear to the front of the supercharger between supercharger rotors, resulting in high pressures at the front of the supercharger. Because the rear of the supercharger must be open to provide a passage for air to enter the supercharger housing, the rotor (or timing) gears are generally at the front of the supercharger, along with rotor shaft bearings, and lubricating oil is present to lubricate the rotor gears and bearings. Front rotor shaft seals are necessary to prevent hot compressed air in the front of the housing from escaping from the housing and heating the lubrication oil, thereby reducing the effectiveness of the oil and causing gear and/or bearing failure, and to prevent the lubricating oil from leaking into the interior of the supercharger.

An unresolved weakness of twin screw superchargers has been the reliability of front rotor shaft seals at high boost levels. While the seals work well at between eight and twenty pounds of boost, increased wear has been observed above twenty pounds of boost. In the past, when boost was typically below twenty pounds the seal failure was not a significant problem. However, modern twin screw superchargers often produce greater than twenty pounds of boost and as a result, seal reliability has become a significant issue. Further, during part boost or no boost, the front rotor shaft seals are known to fail under vacuum and allow the lubricating oil to enter the supercharger interior.

BRIEF SUMMARY OF THE INVENTION

The present invention addresses the above and other needs by providing a pressure equalization system which reduces or eliminates a pressure differential across supercharger rotor shaft seals. Under high boost, rotor shaft seals often fail, allowing hot compressed air into an oil lubricated space containing rotor bearings and gears (and vented to ambient pressure), reducing oil lubricating effectiveness and resulting in increased wear and failure. Under low or non boost operation the pressure differential is reversed causing the lubricating oil to leak into the supercharger interior and accelerated rotor seal wear. The pressure equalization system includes flow restrictive seals on both rotor shafts, separated from the rotor shaft seals by vented spaces, thereby isolating the rotor shaft seals from boost or vacuum in the supercharger interior and reducing or eliminating the pressure differential across the rotor shaft seals. Maintaining close to atmospheric pressure on both sides of the rotor shaft seals during boost and vacuum operation reduces wear and failures.

In accordance with one aspect of the invention, there is provided a combination of the close clearance between rotor ends and an outlet end wall, flow restrictive seals, and the vented intermediate spaces between the flow restrictive seals and rotor shaft seals. The combination of elements reduces a pressure differential across the rotor shaft seals and thereby allows high boost without increased wear and supercharger failure. The reduction of the pressure differential further prevents damage and wear during negative boost (vacuum) conditions.

In accordance with another aspect of the invention, there are provided flow restrictive seals and vented spaces between the flow restrictive seals and rotor shaft seals. The combination of the flow restrictive seals and the vented spaces allows use of lower friction rotor shaft seals, and a reduced pressure differential across the rotor shaft seals further reduces friction, thereby reducing the creation of heat by the rotor shaft seals and the power consumption by the rotor shaft seals.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
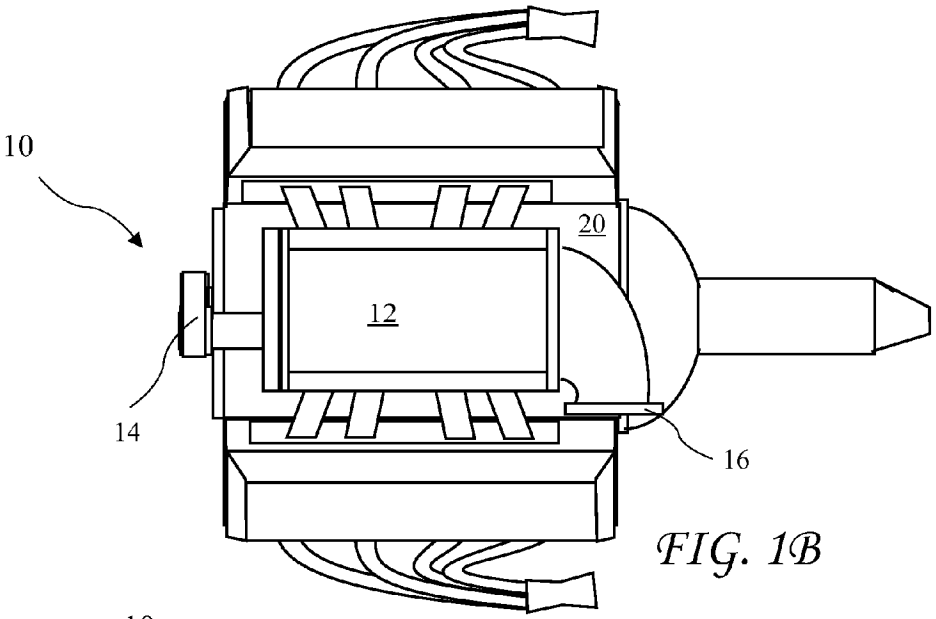
FIG. 1B is a top view of the supercharged engine according to the present invention.
Figure 1A:
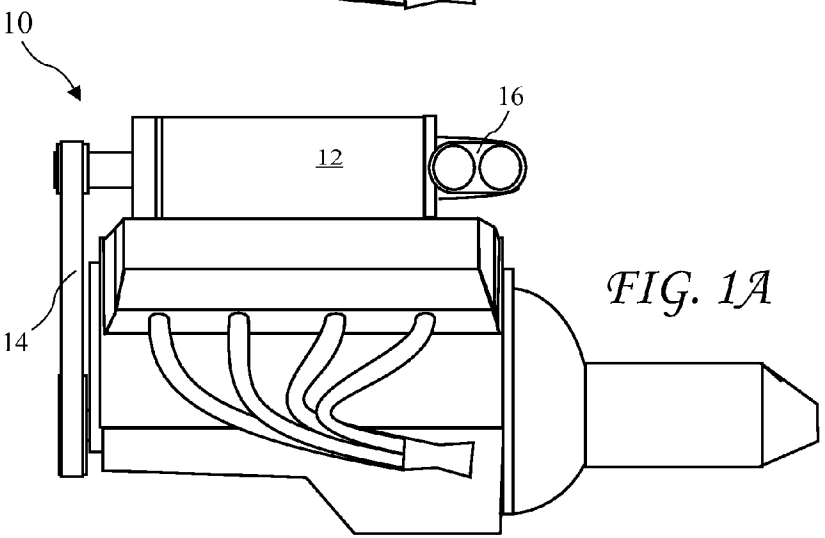
FIG. 1A is a side view of a supercharged engine according to the present invention.
Figure 1C:
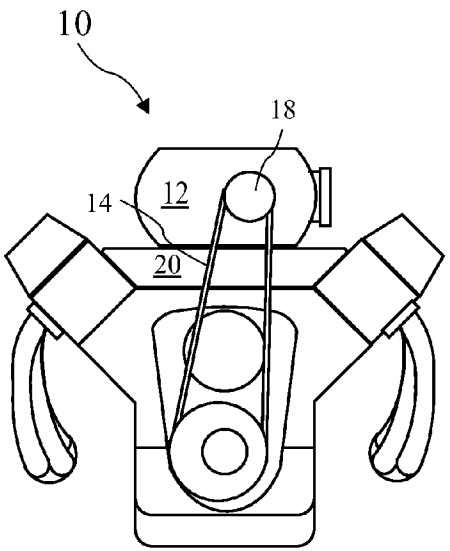
FIG. 1C is a front view of the supercharged engine according to the present invention.

A side view of a supercharged engine 10 according to the present invention is shown in FIG. 1A and a top view of the supercharged engine 10 is shown in FIG. 1B. The supercharged engine 10 includes a screw compressor type supercharger 12 attached to an intake manifold 20. The screw compressor type supercharger 12 compresses air received through a throttle body 16 and provides the compressed air to the supercharged engine 10 through the intake manifold 20 and into the engine 10. The screw compressor type supercharger 12 is driven by a belt 14 connecting a crankshaft pulley to a supercharger pulley.

Figure 2B:
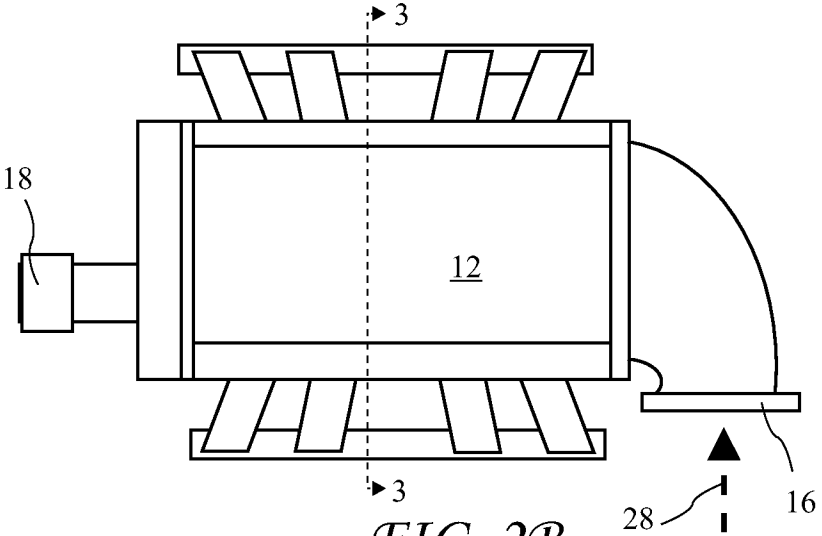
FIG. 2B is a top view of the supercharger and intake manifold according to the present invention.
Figure 2A:
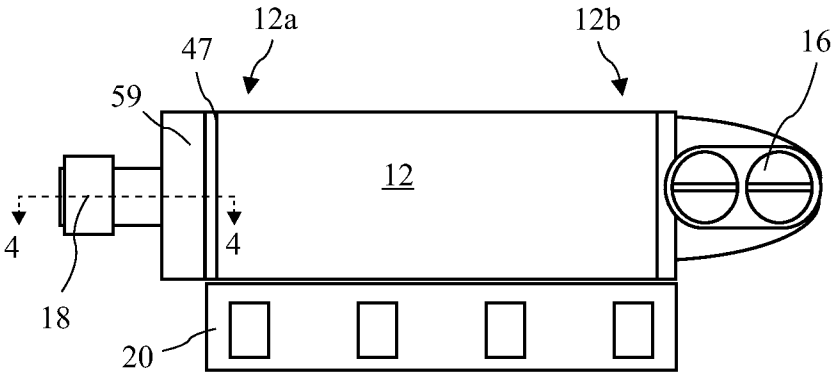
FIG. 2A is a side view of a supercharger and intake manifold according to the present invention.

A side view of the screw compressor type supercharger 12 according to the present invention is shown in FIG. 2A and a top view of the screw compressor type supercharger 12 is shown in FIG. 2B. A supercharger pulley 18 is attached to the screw compressor type supercharger 12 at a front (outlet) end 12*a* of the supercharger, and the throttle body 16 is attached at a rearward end 12*b*. While the supercharger is shown as having the outlet end to the front, belt drives may also be provided to position the inlet end of the supercharger to the front and the supercharger driven from the rear and both the belt and inlet can be at the same end, and such variations are intended to come within the scope of the present invention.

Figure 3:
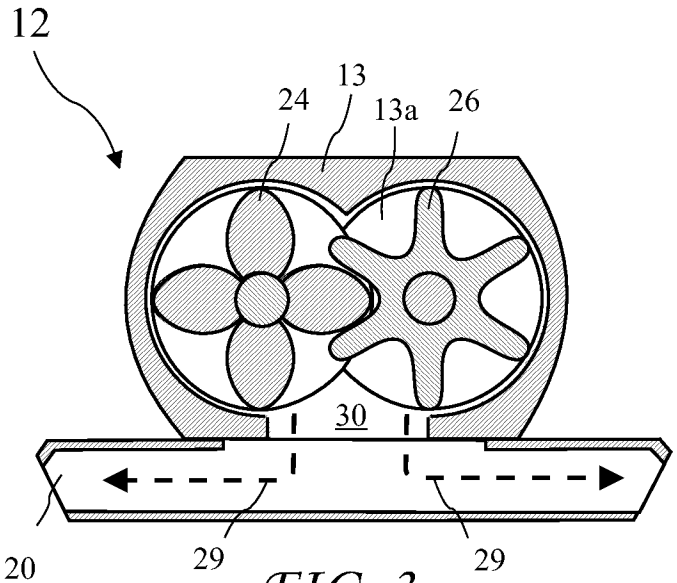
FIG. 3 is a cross-sectional view of the supercharger and intake manifold according to the present invention taken along line 3-3 of FIG. 2B.

A cross-sectional view of the screw compressor type supercharger 12 taken along line 3-3 of FIG. 2B is shown in FIG. 3. A first rotor 24 and a second rotor 26 are rotatably housed in an interior of a housing 13 of the screw compressor type supercharger 12. The rotors 24 and 26 are turned by the pulley 18 and gears 47*a* and 47*b* (see FIG. 4) and draw ambient air 28 through the throttle body 16 and through the rear (inlet) end 12*b* and into the screw compressor type supercharger 12. The ambient air is compressed as it passes through the screw compressor type supercharger 12 by the rotors 24 and 26. The compressed air 29 is pumped through compressed air passage 30 and the intake manifold 20 into the engine 10.

Known superchargers include rotor shaft seals 45 between the rotors 24 and 26, and the rotor shaft bearings 48, and a outer shaft seal 49 between a gear space 46 at the outlet end 12*a* of the supercharger 12 containing the rotor gears 47*a* and 47*b*, and the pulley 18. The rotor shaft seals 45 may be single or double lip seals. The rotor gears 47*b* and 47*b* reside in the space 46 between the seals 45 and seal 49 and the rotor shaft bearings 48 are exposed to the space 46. The space 46 contains lubricating oil for lubricating the gears 47*a* and 47*b* and the bearings 48. The rotor shaft seals 45 are intended to prevent compressed air inside the interior 13*a* of the supercharger 12 from escaping into the space 46 and prevent the lubricating oil in the space 46 from entering the interior 13*a* of the supercharger 12.

Under part or no load, the supercharger 12 internal pressure is reduced and is often below atmospheric pressure (i.e., positive vacuum). Under part load the absolute pressure inside the supercharger may be as low as 0.5 bars, and coasting, as low as 0.05 bars, resulting in a pressure difference across the rotor shaft seals 45 tending to urge the lubricating oil into the interior 13*a* of the supercharger 12. As the pressure difference grows, the friction between the seal lips and the seal ring increases which is a primary cause of seal wear.

Further, the power produced by a supercharging internal combustion engine 10 is increased by increasing the supercharger 12 boost pressure. Increasing the boost pressure results in increased pressure and temperature at the outlet end 12*a* of the supercharger 12. If the boost pressure is very high, for example, greater than twenty pounds, the increased pressure has resulted in the hot compressed air in the interior 13*a* of the supercharger 12 escaping past the seals 45 (see FIG. 5) past the bearings 48 and into the space 46 at the outlet end 12*a* of the supercharger 12 which contains supercharger rotor (or timing) gears 47*a* and 47*b*, thereby causing increased wear and eventually failure of the seals 45, the bearings 48, and the gears 47*a* and 47*b*. One solution to the potential leakage of the hot compressed air into the space 46 is to add flow restrictive seals between the rotors 24 and 26 and the bearing 45. Unfortunately, merely adding such seals does not sufficiently limit the flow of the hot compressed air into the space 46 to prevent wear and failure.

Single lip seals might be used, with the lips opening outward under boost, away from the rotor shafts and against the seal seat, and seal wear is not a problem, but the compressed air flowing from the supercharger interior into the space 46 carries lubricating oil out of the space 46 through the vent 53.

Another potential measure is to controllably vent the space 46 to ambient air through a vent 53 to allow the hot compressed air to escape the space 46 in a controlled manner, for example, not blowing the lubricating oil onto the supercharger pulley 18 and belt 14. However, such vent 53 still allows the escape of the lubricating oil under high boost when the hot compressed air pushes past the sealing lips of the shaft seals 45 and into the space 46 and create a mist of the hot compressed air and the lubricating oil from space 46 through the vent 53 to the ambient air. Such vent 53 also does not address the flow of lubricating oil from the space 46 into the supercharger interior 13*a* under vacuum.

Figure 4:
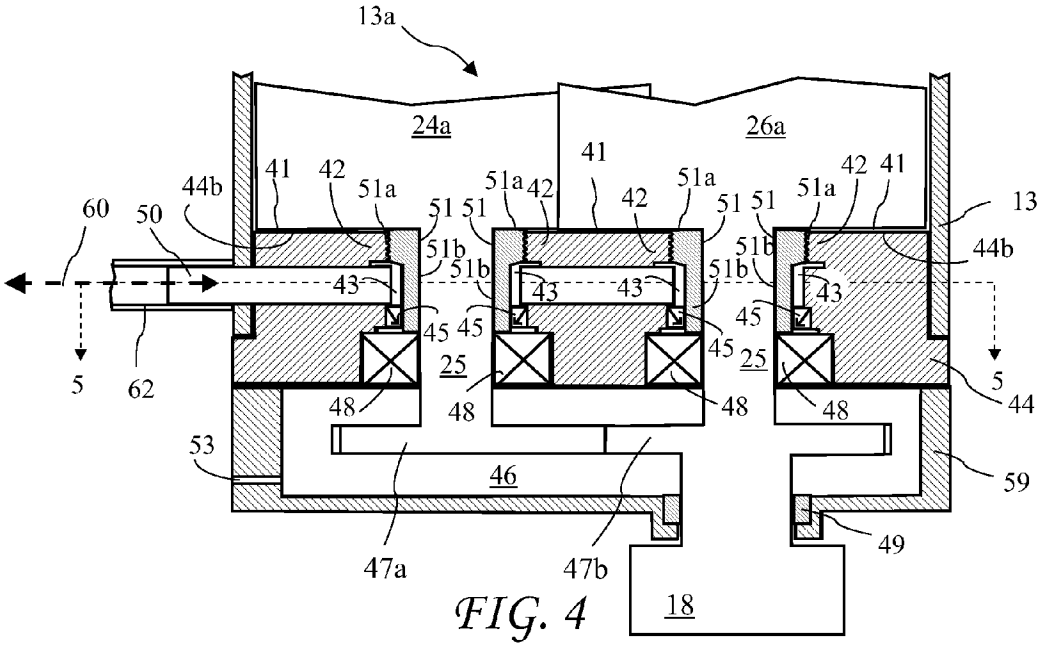
FIG. 4 is a cross-sectional view of the supercharger outlet end wall taken along line 4-4 of FIG. 2A.
Figure 6:
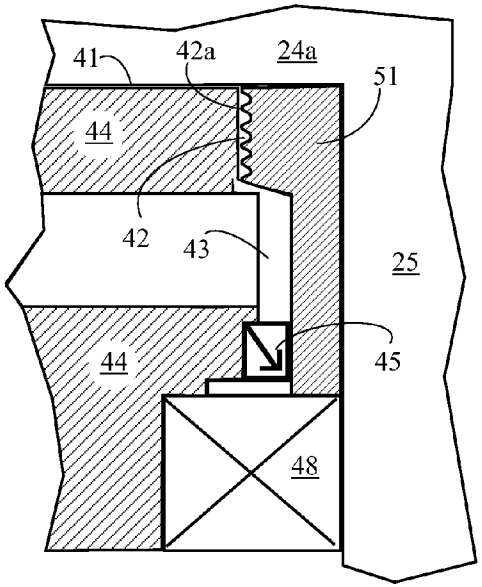
FIG. 6 is a detailed view of the supercharger outlet end seals according to the present invention.
Figure 5:
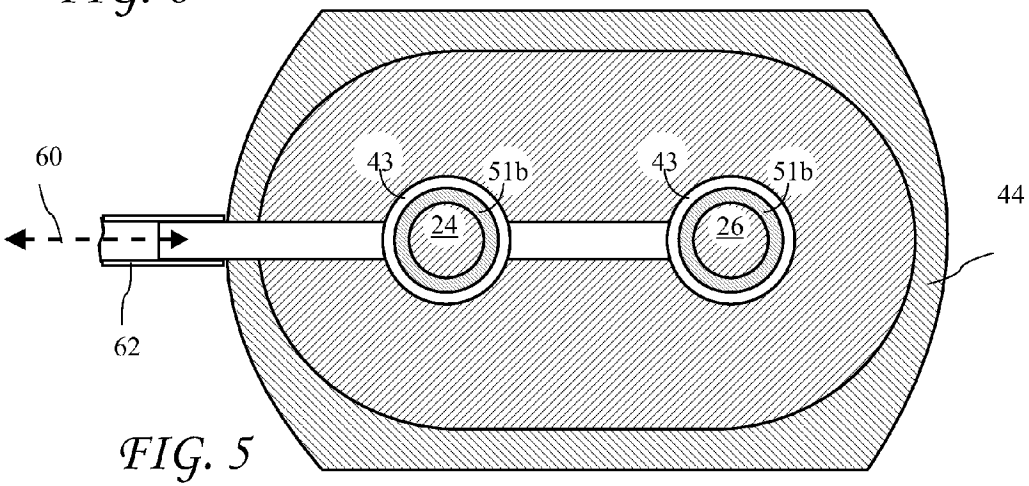
FIG. 5 is a cross-sectional view of the supercharger outlet end wall taken along line 5-5 of FIG. 4.

A top cross-sectional view of the supercharger outlet end 12*a* according to the present invention, taken along line 4-4 of FIG. 2A, is shown in FIG. 4, a front cross-sectional view of the supercharger outlet end wall 44 taken along line 5-5 of FIG. 4 is shown on FIG. 5, and a detailed cross-sectional view of the seals 45 and 51 is shown in FIG. 6. The supercharger 12 according to the present invention addresses the above problems by providing a close clearance 41 between ends of the rotors 24 and 26 and outlet end wall 44, flow restrictive seals 51, and vented intermediate spaces 43 between the seals 51 and the shaft seals 45. The clearance 41 is preferably approximately 0.2 mm. Both sides of the rotor shaft seals 45 are thus vented to ambient air pressure.

The combination of the close clearance 41 and the flow restrictive seals 51 limits the escape of the hot compressed air to the bearings 48, gears 47*a* and 47*b*, and lubrication oil. The vents 50 and 53 keep the pressure in both the spaces 43 and 46 straddling the rotor shaft seals 45 near ambient air pressure and thus at about the same pressure, thereby limiting any flow past the rotor shaft seals 45. The novel synergistic combination of the close clearance 41, the flow restrictive seals 51, and the vented intermediate spaces 43 between the seals 51 and the seals 45, allow high boost without increased wear and supercharger failure by reducing the pressure difference across the rotor shaft seals 45 during both high boost and negative boost (vacuum) conditions.

The flow restrictive seals 51 rotate with the rotor shafts 25 and have a flange 51*a* residing in recesses in the rotor side of the outlet end wall 44, and a cylindrical portion 51*b* reaching further into the outlet end wall 44. The outer diameter of the flange 51*a* includes a sealing surface 42 for sealing against a cooperating surface of the outlet end wall 44. The radial clearance between the sealing surface 42 and the recess in the outlet end wall 44 is extremely small and is preferably approximately 0.05 mm. The sealing surface 42 preferably includes several "sharp" edges 42*a* which allow the sealing surface 42 to contact the recesses in outlet end wall 44 without seizing or creating friction. The restrictive seals 51 are preferably made from hardened steel or the equivalent and the sealing surfaces 42 are preferably a labyrinth type seal to provide low friction while restricting the flow of air past the seal by providing a restrictive path for escaping air. A combination of a tight clearance 41 between ends of the rotors 24 and 26 and a rear face 44*b* of the outlet end wall 44, and the labyrinth sealing surfaces 42, allows only a small flow of the hot compressed air inside the supercharger interior 13*a* at the outlet end 12*a* to escape into an annular space 43 between the rotors 24 and 26 and the rotor shaft seals 45 in the outlet end wall 44.

A passage 50 intersects both of the spaces 43 and vents the spaces 43 to ambient air pressure or to near ambient air pressure. Under high boost, an airflow 60 flows from the spaces 43 and under low or no boost (or vacuum), and the air flow 60 flows into the spaces 43. The space 46 on the opposite side of the shaft seals 45 is also vented to ambient air by a passage 53. Because spaces on both sides of the shaft seal 45 are vented to ambient air pressure or to near ambient air pressure, the present invention addresses both the pressure difference across the rotor shaft seals 45 at high load (boost in the supercharger interior 13*a*) as well as part or no load (vacuum in the supercharger interior 13*a*). The labyrinth sealing surfaces 42 allow a very small clearance to reduce the air flows into the spaces 43 and through the passage 50, thereby not reducing performance under boost and providing safe operation. The labyrinth seal preferably has a radial clearance of approximately 0.05 mm. The passage 50 is drilled in the outlet end wall 44, and communicating with the two spaces 43 for draining of those to the ambient pressure at high boost and pressurizing spaces 43 from the ambient at low or no boost.

Figure 7:
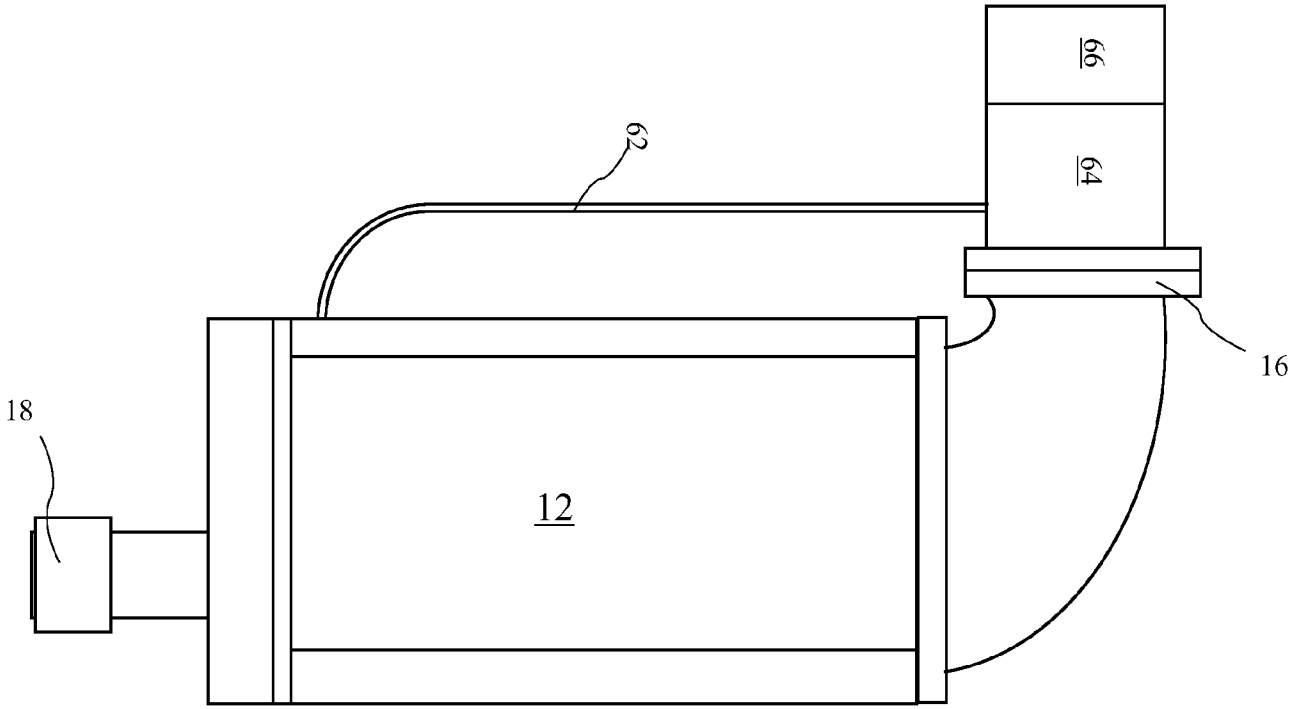
FIG. 7 shows a top view of the supercharger with the outlet end wall vented to the supercharger air intake.

A top view of the supercharger 12 according to the present invention showing a hose 62 connecting the passage 50 to the superchargers inlet manifold 64 downstream the air mass flow meter 66 and upstream the throttle body 16 is shown in FIG. 7.

Figure 8:
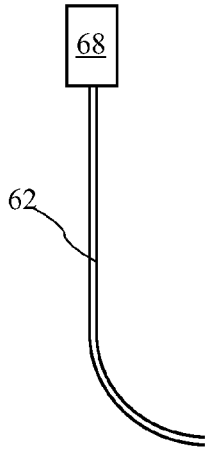
FIG. 8 shows the outlet end wall vented to a filter.

An alternative embodiment with the hose 62 connected to a filter 68 is shown in FIG. 8. Because the air flow through the passage 50 is small it is often acceptable to let ambient air to enter the passage 50 directly via the small filter 68. The filter 68 prevents particles from entering into the supercharger 12, while providing ambient pressure at the spaces 43. At high boost, space 43 will be drained down to the ambient pressure through an outflow through the filter 68, thereby having a cleaning effect on the filter 68.

While the invention herein disclosed has been described by means of specific embodiments and applications thereof, numerous modifications and variations could be made thereto by those skilled in the art without departing from the scope of the invention set forth in the claims.

I claim:

1. An engine system comprising:

an engine;

an engine intake manifold providing a flow of compressed air into the engine;

a screw type supercharger having a pressure differential equalization system and being in fluid communication with the engine intake manifold providing the flow of compressed air into the intake manifold;

an inlet end of the screw type supercharger receiving ambient air;

an outlet end of the screw type supercharger opposite the inlet end of the screw type supercharger;

a path through an interior of the screw type supercharger for the ambient air from the inlet end of the screw type supercharger to the outlet end of the screw type supercharger with increasing pressure and temperature as the ambient air is compressed along the path to produce the flow of compressed air;

an outlet end wall at the outlet end of the supercharger;

rotor shafts;

rotor shaft bearings residing between the rotor shafts and the outlet end wall and providing for rotation to the rotors with respect to the outlet end wall;

rotor gears attached to the rotor shafts and residing in a gear space separated from the interior of the screw type supercharger by the outlet end wall;

flow restrictive seals extending radially between rotor shafts and the outlet end wall, the flow restrictive seals reducing a flow of the compressed air from the supercharger interior into the gear space;

rotor shaft seals between the flow restrictive seals and the rotor shaft bearings;

annular spaces between the flow restrictive seals and the rotor shaft seals; and a pressure vent connecting the annular spaces to ambient air pressure.

2. The engine of claim 1, wherein the gear space is vented to ambient air pressure.

3. The engine of claim 1, wherein the flow restrictive seals include labyrinth seals for restricting the flow of the compressed air from the supercharger interior into the gear space.

4. The engine of claim 3, wherein:

the flow restrictive seals are fixed to the rotor shafts and rotate with the rotor shafts; and the labyrinth seals are on outside radii of the flow restrictive seals and cooperate with adjacent surfaces of the outlet end wall for restricting the flow of the compressed air from the supercharger interior into the gear space.

5. The engine of claim 4, wherein the adjacent surfaces of the outlet end wall are cylindrical surface.

6. The engine of claim 4, wherein the flow restrictive seals include flange portions and labyrinth seals reside on outside radii of the flange portions and cooperating with adjacent cylindrical surfaces of the outlet end wall for restricting the flow of the compressed air from the supercharger interior into the gear space.

7. The engine of claim 6, wherein:

the flow restrictive seals include cylindrical portions extending forward from the flange portions and into the outlet end wall; and the rotor shaft seals reside radially against outside surfaces of the cylindrical portions of the flow restrictive seals and reside axially between the flange portions of the flow restrictive seals and the rotor shaft bearings.

8. The engine of claim 7, wherein the annular spaces are defined axially between the flange portions of the flow restrictive seals and the rotor shaft seals and outside the outside surface of the cylindrical portions of the flow restrictive seals.

9. The engine of claim 4, wherein outlet ends of the rotors and the outlet end wall cooperate to provide a close clearance to further restrict the flow of the compressed air from the supercharger interior into the gear space.

10. An engine system comprising:

an engine;

an engine intake manifold providing a flow of compressed air into the engine;

a screw type supercharger having a pressure differential equalization system and being in fluid communication with the engine intake manifold providing the flow of compressed air into the intake manifold;

an inlet end of the screw type supercharger receiving ambient air;

an outlet end of the screw type supercharger opposite the inlet end of the screw type supercharger;

a path through an interior of the screw type supercharger for the ambient air from the inlet end of the screw type supercharger to the outlet end of the screw type supercharger with increasing pressure and temperature as the ambient air is compressed along the path to produce the flow of compressed air;

an outlet end wall at the outlet end of the supercharger;

rotor shafts;

rotor shaft bearings residing between the rotor shafts and the outlet end wall and providing for rotation to the rotors with respect to the outlet end wall;

rotor gears attached to the rotor shafts and residing in a gear space vented to ambient air pressure, rotor gears separated from the interior of the screw type supercharger by the outlet end wall;

flow restrictive seals fixed to the rotor shafts and rotating with the rotor shafts and extending radially between rotor shafts and the outlet end wall;

labyrinth seals on outside radii of the flow restrictive seals and cooperating with adjacent cylindrical surfaces of the outlet end wall for restricting the flow of the compressed air from the supercharger interior into the gear space rotor shaft seals between the flow restrictive seals and the rotor shaft 26 bearings;

annular spaces between the flow restrictive seals and the rotor shaft seals; and a pressure vent connecting the annular spaces to ambient air pressure.

11. An engine system comprising:

an engine;

an engine intake manifold providing a flow of compressed air into the engine;

a screw type supercharger having a pressure differential equalization system and being in fluid communication with the engine intake manifold providing the flow of compressed air into the intake manifold;

an inlet end of the screw type supercharger receiving ambient air;

an outlet end of the screw type supercharger opposite the inlet end of the screw type supercharger;

a path through an interior of the screw type supercharger for the ambient air from the inlet end of the screw type supercharger to the outlet end of the screw type supercharger with increasing pressure and temperature as the ambient air is compressed along the path to produce the flow of compressed air;

an outlet end wall at the outlet end of the supercharger;

rotor shafts;

rotor shaft bearings residing between the rotor shafts and the outlet end wall and providing for rotation to the rotors with respect to the outlet end wall;

rotor gears attached to the rotor shafts and residing in a gear space vented to ambient air pressure, rotor gears separated from the interior of the screw type supercharger by the outlet end wall;

flow restrictive seals fixed to the rotor shafts and rotating with the rotor shafts and extending radially between rotor shafts and the outlet end wall;

flange portions of the flow restrictive seals including labyrinth seals on outside radii of the flow restrictive seals and cooperating with adjacent cylindrical surfaces of the outlet end wall for restricting the flow of the compressed air from the supercharger interior into the gear space;

cylindrical portions of the flow restrictive seals extending forward from the flange portions into the outlet end wall;

rotor shaft seals residing radially against the cylindrical portions of the flow restrictive seals and residing axially between the flange portions of the flow restrictive seals and the rotor shaft bearings;

annular spaces between the flange portions of the flow restrictive seals and the rotor shaft seals residing on an outside surface of the cylindrical portions of the flow restrictive seals;

a throttle body controlling the entry of air into the supercharger interior; and a pressure vent connecting the annular spaces to a section of intake air 37 ducting before the throttle body.

* * * * *